US005147515A

United States Patent [19]

Hanagata et al.

[11] Patent Number: 5,147,515

[45] Date of Patent: Sep. 15, 1992

[54] METHOD FOR FORMING CERAMIC FILMS BY ANODE-SPARK DISCHARGE

[75] Inventors: Haruo Hanagata, Ebina; Tsukasa Suzuki; Kazuo Yanagida, both of Kasukabe; Hidesato Igarashi, Tokyo, all of Japan

[73] Assignee: Dipsol Chemicals Co., Ltd., Tokyo, Japan

[21] Appl. No.: 573,703

[22] Filed: Aug. 28, 1990

[30] Foreign Application Priority Data

Sep. 4, 1989 [JP] Japan ..... 1-228639
Mar. 6, 1990 [JP] Japan ..... 2-54827

[51] Int. Cl.[5] ..... H05F 3/04

[52] U.S. Cl. ..... 204/164; 205/320; 205/321; 205/322; 205/323; 427/37

[58] Field of Search ..... 204/56.1, 58, 58.4, 204/164; 427/37; 106/628, 635, 637; 264/22; 205/321, 322, 323, 320

[56] References Cited

U.S. PATENT DOCUMENTS 3,812,021 5/1974 Craig et al. ..... 204/58
3,812,022 5/1974 Rogers et al. ..... 204/58
3,832,293 8/1974 Hradcovsky et al. ..... 204/58.4
3,956,080 5/1976 Hradcovsky et al. ..... 204/58.4
3,960,676 6/1976 Miyosawa et al. ..... 205/323

FOREIGN PATENT DOCUMENTS 151330 10/1981 Fed. Rep. of Germany .
156003 7/1982 Fed. Rep. of Germany .

*Primary Examiner*—John Niebling
*Assistant Examiner*—Brian M. Bolam
*Attorney, Agent, or Firm*—Oblon, Spivak, McClelland, Maier & Neustadt

[57] ABSTRACT

A method for forming a ceramics film on the surface of a substrate comprises performing spark discharge in an electrolytic bath, wherein the electrolytic bath comprises an aqueous solution of a water-soluble or colloidal silicate and/or an oxyacid salt to which ceramics fine particles and/or specific fine particles are dispersed and the spark discharge is carried out in the electrolytic bath while ensuring the suspended state of the ceramics particles and/or the specific fine particles in the electrolytic bath. The method makes it possible to effectively form, on the surface of a metal substrate, ceramics films having a variety of color tones as well as excellent insulating properties and hardness. Moreover, it further makes it possible to effectively form a composite ceramics film having excellent wear resistance on the surface of a metal substrate.

13 Claims, No Drawings

METHOD FOR FORMING CERAMIC FILMS BY ANODE-SPARK DISCHARGE

BACKGROUND OF THE INVENTION

The present invention relates to a method for forming a ceramics film on the surface of a metal substrate through anode-spark discharge and more specifically to a method for co-depositing fine ceramic particles and/or specific fine particles with ceramics components dissolved in the bath on the surface of a metal substrate by performing the spark discharge in a bath comprising a suspension containing these particles.

Ceramic films formed through an anode-spark discharge technique exhibit various excellent properties such as electrical insulating properties, low outgassing properties under ultra-high vacuum, corrosion resistance, flexibility and adhesion and, therefore, the spark discharge technique has become a center of attention as a technique for forming films.

Under such circumstances, there have been a variety of patents which relate to techniques for forming films by use of the spark discharge. For instance, U.S. Pat. Nos. 3,822,293; 3,834,999 and 4,082,626 disclose methods for forming films which comprise dissolving an alkali metal silicate or an alkali metal hydroxide or a combination of such an alkali with an oxyacid catalyst in water and performing spark discharge in the aqueous solution. In addition, Japanese Patent Publication for Opposition Purpose (hereunder referred to as "J. P. KOKOKU") No. Sho 58-17278 discloses a method for forming a film by use of an electric current having a specific wave form, which makes it possible to form a protective film on the surface of an aluminum substrate in an efficiency higher than that achieved by the foregoing methods disclosed in the U.S. Patents J. P. KOKOKU Nos. Sho 59-28636 and Sho 59-45722 also disclose methods for forming a colored protective film having a variety of color tones on an aluminum substrate, in which a metal salt or the like is added to an electrolytic bath.

On the other hand, J. P. KOKOKU No. Sho 59-28637 discloses a method for effectively forming a film on a magnesium or alloy substrate by use of an electric current having a specific wave form and J. P. KOKOKU No. Sho 59-28638 discloses a method for forming a protective film having a variety of color tones.

The foregoing methods disclosed in the aforementioned patents make it possible to form films having the foregoing characteristics, but the resulting films have low hardness, insufficient dielectric breakdown voltage and low film-forming velocity depending on the kinds of the electrolytic bath. In other words, these methods are not practical.

SUMMARY OF THE INVENTION

Accordingly, a primary object of the present invention is to provide a method for effectively forming, on the surface of a metal substrate, a ceramic film having a variety of color tones as well as excellent insulating properties and hardness by anode-spark discharge.

Another object of the present invention is to provide a method for effectively forming a composite ceramics film having excellent wear resistance on the surface of a metal substrate by anode-spark discharge.

These and other objects of the present invention will be clear from the following description and Examples.

The present invention has been completed on the basis of the finding that the foregoing objects of the present invention can effectively be achieved if fine ceramics particles and/or specific fine particles are suspended in an electrolytic bath for forming a ceramic film on a metal substrate by anode-spark discharge and these suspended particles are deposited on the substrate simultaneously with components of the electrolytic bath.

According to a first aspect of the present invention, there is provided a method for forming a ceramic film on the surface of a substrate by spark discharge performed in an electrolytic bath, wherein the electrolytic bath comprises an aqueous solution of a water-soluble or colloidal silicate and/or an oxyacid salt to which ceramic fine particles are dispersed and the spark discharge is carried out in the electrolytic bath while ensuring the suspended state of the ceramics particles in the electrolytic bath.

According to a second aspect of the present invention, there is provided a method for forming a ceramic film on the surface of a substrate by spark discharge performed in an electrolytic bath, wherein the electrolytic bath comprises an aqueous solution of a water-soluble or colloidal silicate and/or an oxyacid salt, to which fine particles of a member selected from the group consisting of molybdenum disulfide, carbon, fluorinated graphite and tetrafluoroethylene resin are dispersed and the spark discharge is carried out in the electrolytic bath while ensuring the suspended state of the fine particles in the bath.

DESCRIPTION OF THE PREFERRED EMBODIMENTS

The electrolytic bath used in the present invention is a dispersion comprising an aqueous solution containing a water-soluble or colloidal silicate and/or at least one oxyacid salt selected from the group consisting of tungstates, stannates, molybdates, borates, aluminates, phosphates or the like, to which fine particles of ceramics are dispersed. To the electrolytic bath, there may be added metal ions such as Ni, Co, Zn, Ca, Ba, Mg, Pb or Cr ions or mixture thereof in the form of a water-soluble salt. Examples of the silicates are a variety of water-soluble ones represented by the general formula: $M_2O.nSiO_2$ (wherein M represents an alkali metal and n is a positive number ranging from 0.5 to 100) such as sodium silicate, potassium silicate, lithium silicate and those capable of being dispersed in water such as colloidal silica. These silicates may be use alone or in combination.

The concentration of the silicate and/or the oxyacid salt in the aqueous solution used as the electrolytic bath in the invention is preferably not less than 5 g/l and more preferably 25 to 200 g/l, respectively. In particular, if an oxyacid salt is used in an amount almost equal to its saturation, the highest film-forming velocity can be achieved, but the resulting film is often non-uniform as the concentration thereof increases. For this reason, the concentration thereof is desirably limited to the range defined above. The pH value of the electrolytic bath is not particularly limited, but preferably ranges from 3 to 13.5.

In the first aspect of the invention, various kinds of fine particles which are insoluble in the aqueous solution and capable of being dispersed therein can be used as the ceramic fine particles to be added to the aqueous solution. Specific examples thereof include oxide type ceramic such as $Al_2O_3$, $Al(OH)_3$, $SiO_2$, $3Al_2O_3.2SiO_2$, $TiO_2$, $ZrO_2$ and $Cr_2O_3$ and non-oxide type ceramics such as SiC, TiC, TiN, TiB, ZrB, BN, WC, $WSi_2$ and $MoSi_2$. These ceramic particles may be used alone or in combination.

The particle size of the ceramic particles desirably ranges from 0.03 to 100 μm, in particular 0.03 to 20 μm. That is, when the particle size thereof is increased, it is difficult to co-deposite the ceramic particles and if they are co-deposited the resulting film is non-uniform.

The amount of the fine particles of ceramic to be added to the electrolytic bath can be arbitrarily determined depending on the kinds of the electrolytes in which the fine particles are dispersed and the amount of the fine particles to be dispersed, but is in general up to 200 g/l and most preferably ranges from 5 to 100 g/l from the viewpoint of the efficiency of the deposition.

Examples of the fine particles used in the second aspect of the present invention are molybdenum disulfide, carbon, fluorinated graphite, tetrafluoroethylene resin or mixture thereof. Graphite is preferable as a carbon component used herein. These fine particles have self-lubricating properties, are hence taken in the ceramic film during the spark discharge to thus give a film having good wear resistance.

In this embodiment, the fine ceramic particles used in the first aspect of the invention can be used together with the fine particles having self-lubricating properties.

The particle size of the fine particles having self-lubricating properties desirably ranges from 0.01 to 100 μm and preferably 0.03 to 20 μm. That is, when the particle size thereof is increased, it is difficult to co-deposite the ceramic particles and if they are co-deposited the resulting film is non-uniform.

The amount of the fine particles having self-lubricating properties to be added to the electrolytic bath can be arbitrarily determined depending on the kinds of the electrolytes in which the fine particles are dispersed and the amount of the fine particles to be dispersed, but is in general up to 200 g/l and most preferably ranges from 5 to 100 g/l from the viewpoint of the efficiency of the deposition.

In the first and second aspects of the present invention, examples of the metal substrates on which a ceramic film can be formed by the spark discharge technique include those made from aluminum and alloys thereof; zirconium, titanium, niobium, magnesium and alloys thereof.

When a film is formed on a metal substate by spark discharge, the substrate must not be subjected to a particular pretreatment, but it is desirable to sufficiently clean the surface of the substrate through degreasing, etching, washing with an acid or the like.

An insoluble electrode is used as a cathode and the cathode may be formed from, for instance, iron, stainless steel, nickel or the like.

In the method of the present invention, the spark discharge is carried out in the electrolytic bath defined above while ensuring the suspended state of the ceramic particles in the electrolytic bath. The ceramic fine particles sediment due to the gravitational action or the self-weight and thus it is important to conduct the spark discharge while maintaining the suspended state of the particles in the usual manner. The retention of such suspended state can be performed by stirring or circulation of the electrolyte.

When fine particles having poor dispersion properties are employed, there may be used a dispersant, for instance, a surfactant such as cationic, non-ionic or anionic ones for obtaining a good dispersion.

The temperature of the electrolytic bath during the spark discharge in general ranges from 5° to 90° C. and preferably 15° to 60° C. This is because, if it is too low, the film-forming velocity by the spark discharge is low, while if it is too high, it is liable to form a non-uniform film.

In addition, if the current density used is too low, the fine particles are hardly deposited, while if it is too high, a film having a low particle density or a coarse film is formed at high current portions. Therefore, the current density preferably ranges from 0.2 to 20 $A/dm^2$, more preferably 1 to 5 $A/dm^2$.

The output from a power supply may be a direct current having any wave form, but preferably those having pulse shape (rectangular wave form), saw-tooth wave form or DC half-wave form.

The spark discharge-initiating voltage varies depending on various factors such as the wave form of the output current from the dc power supply, the concentration of the silicate and that of the oxyacid salt and the temperature of the bath, but it desirably ranges from 50 to 200 V. Moreover, the voltage observed during the film formation is increased as the spark discharge proceeds and the final voltage sometimes exceeds 1,000 V.

The electrolysis time varies depending on the desired thickness of the resulting film. However, if the resulting film is thin, the film does not show the quality peculiar thereto. Therefore, the electrolysis must be performed for at least 5 minutes. In general, practically acceptable films having a thickness, for instance, ranging from 2 to 80 μm can be obtained if the electrolysis is performed for 10 to 60 minutes.

According to the first aspect of the present invention, there can effectively be prepared metallic materials having ceramic films having high insulating properties, high hardness and a variety of color tones.

Low outgassing properties, corrosion resistance and fastness properties can be imparted to an apparatus for manufacturing semiconductor devices by applying a ceramic film onto the shroud or the chamber of a reaction vessel of the apparatus according to the method of this invention. Moreover, if an aluminum or aluminum clad copper conductors is provided with a ceramic coating, there can be obtained an electric wire coated with the ceramic layer having high dielectric breakdown voltage in addition to high flexibility and whose coated layer is hardly broken even if the layer has a flaw.

According to the method of this invention, the color tone of the resulting films is rather white depending on the kinds of the fine particles used and, therefore, the method can also be useful as a whitening treatment for aluminum construction materials.

If a ceramic film is applied onto a container for cosmetics comprising an aluminum material according to the method of this invention, there can be obtained a container for cosmetics having beautiful appearance of a variety of color tones and free of hit marks.

In addition, if a ceramic film is applied onto a heater of aluminum, a far infrared radiator having excellent far infrared emission properties and free of hit marks can be obtained.

The second aspect of the present invention makes it possible to effectively produce metallic materials having a ceramic composite layer thereon excellent in wear resistance.

Thus, if the composite film of the present invention is, for instance, applied onto sliding faces of movable portions in a vacuum vessel, an apparatus having excellent gas discharge properties, corrosion resistance and durability can be obtained. Moreover, if it is applied onto the sliding faces of movable portions of an apparatus, the apparatus operated at a high temperature is made heat resistant, corrosion resistant and durable.

Further, if the ceramics composite film is used as a coating for electric wires used in a vacuum or a radiation atmosphere, signal lines or the like which are excellent in gas discharge properties and corrosion resistance and which is hardly damaged due to wearing such as friction can be obtained.

The far infrared radiation properties of the ceramic films can be further enhanced by incorporation of carbon into the films and, therefore, such films can be used for obtaining heaters having more excellent far infrared radiation properties. In addition, the appearance of the resulting films becomes black by the incorporation of carbon into the ceramic films and, therefore, this can be used for ornamental purposes.

The present invention will hereinafter be explained in more detail with reference to the following non-limitative working Examples and the effects practically attained by the invention will also be discussed in comparison with Comparative Examples given below.

EXAMPLE 1

An aluminum plate was degreased, etched with an alkali and activated with an acid to clean the plate. Spark discharge was carried out in a suspension obtained by suspending a silicate fine particles (available from Tokuyama Soda Co., Ltd. under the trade name of FINE SHEEL E-50 having an average particle size of 2.0 μm) in an aqueous solution of $Na_2B_4O_7.10H_2O$ (70 g/l) in an amount of 15 g/l, using the aluminum plate as an anode and a stainless steel plate as a cathode. In this stage, the electrolyte was sufficiently stirred so as not to cause sedimentation of the silicate fine particles to thus ensure a good suspended state thereof. The spark discharge was continued at a current density of 3 A/dm$^2$ and a temperature of 50° C. for 20 minutes to give a film having a thickness of 35 μm. The film was analyzed by an X-ray microanalyzer. As a result, the presence of Si, O, B and Na was detected. This indicates that a ceramic film containing a silicate was certainly formed.

EXAMPLE 2

An electric current was passed, at a current density of 1 A/dm$^2$ for 20 minutes, through the same anode and cathode used in Example 1 dipped in a dispersion obtained by suspending 20 g/l of $Al_2O_3$ fine particles (available from SHOWA DENKO KK. under the trade name of LOW SODA ALUMINA AL-45A, the average particle size thereof=1.1 μm) in a 200 g/l aqueous solution of $K_2O.nSiO_2$ maintained at 50° C. As a result, a spark discharge was caused on the anode surface and thus a film having an average thickness of 31 μm was obtained. During the spark discharge, the suspended state of the fine particles was ensured in the same manner as in Example 1.

EXAMPLE 3

An electric current was passed, at a current density of 3 A/dm$^2$ for 30 minutes, through the same anode and cathode used in Example 1 dipped in a dispersion obtained by suspending 20 g/l of the same $Al_2O_3$ fine particles used in Example 2 in a 70 g/l aqueous solution of $Na_4P_2O_7.10H_2O$ maintained at 50° C. As a result, a spark discharge was caused on the anode surface and thus a film having an average thickness of 28 μm was obtained. During the spark discharge, the suspended state of the fine particles was ensured in the same manner as in Example 1.

EXAMPLE 4

An electric current was passed, at a current density of 3 A/dm$^2$ for 20 minutes, through the same anode and cathode used in Example 1 dipped in a dispersion obtained by suspending 20 g/l of $Al(OH)_3$ fine particles (available from SHOWA DENKO KK. under the trade name of SAIRYU.BIRYU HYGILITE H-43, average particle size=0.6 μm) in a 70 g/l aqueous solution of $Na_4P_2O_7.10H_2O$ maintained at 50° C. As a result, a spark discharge was caused on the anode surface and thus a film having an average thickness of 27 μm was obtained. During the spark discharge, the suspended state of the fine particles was ensured in the same manner as in Example 1.

EXAMPLE 5

An electric current was passed, at a current density of 3 A/dm$^2$ for 30 minutes, through an anode which was a titanium plate cleaned by degreasing and etching with an acid and a cathode of stainless steel plate dipped in a dispersion obtained by suspending 20 g/l of the same $Al_2O_3$ fine particles used in Example 2 in a 70 g/l of the same aqueous solution of $Na_4P_2O_7.10H_2O$ used in Example 3 maintained at 50° C. As a result, a spark discharge was caused on the anode surface and thus a film having an average thickness of 36 μm was obtained. During the spark discharge, the suspended state of the fine particles was ensured in the same manner as in Example 1.

The resulting film was analyzed by an X-ray microanalyzer and the presence of Ti, Al and P was detected. This indicates that a ceramic film containing Al fine particles was certainly formed.

EXAMPLE 6

An electric current was passed, at a current density of 1 A/dm$^2$ for 30 minutes, through an anode which was an aluminum plate cleaned in the same manner as in Example 1 and a cathode of stainless steel plate dipped in a dispersion obtained by suspending 50 g/l of $Cr_2O_3$ fine particles (available from Nippon Electric Industries, Ltd. under the trade name of ND-802, average particle size=0.7 μm) in an 80 g/l aqueous solution of $Na_4P_2O_7.10H_2O$ maintained at 30° C. As a result, a spark discharge was caused on the anode surface and thus a film having an average thickness of 14 μm was obtained. During the spark discharge, the suspended state of the fine particles was ensured in the same manner as in Example 1. The resulting film was analyzed by an X-ray microanalyzer and the presence of Cr and O was detected. This indicates that a ceramic film containing Cr was certainly formed.

EXAMPLE 7

Spark discharge was performed as in the same manner used in Example 6 except that the amount of $Na_4P_2O_7.10H_2O$ was changed to 60 g/l and that of $Cr_2O_3$ fine particles to 70 g/l. As a result, a spark discharge was caused on the anode surface and thus a green film having an average thickness of 15 μm was obtained.

EXAMPLE 8

An electric current was passed, at a current density of 3 A/dm$^2$ for 30 minutes, through an anode which was an aluminum plate cleaned in the same manner as in Example 1 and a cathode of stainless steel plate dipped in a dispersion obtained by suspending 5 g/l of SiC fine particles (available from SHOWA DENKO KK. under the trade name of ULTRADENSIC DV A-2, average particle size=0.65 μm) in a 100 g/l aqueous solution of $Na_2B_4O_7.10H_2O$ maintained at 40° C. As a result, a spark discharge was caused on the anode surface and thus a film having an average thickness of 28 μm was obtained. During the spark discharge, the suspended state of the fine particles was ensured in the same manner as in Example 1. The resulting film was analyzed by an X-ray microanalyzer and the presence of Si and C was detected. This indicates that a ceramic film containing SiC was certainly formed.

COMPARATIVE EXAMPLE 1

Spark discharge was generated in a 70 g/l aqueous solution of $Na_2B_4O_7.10H_2O$ using an aluminum plate which had been treated in the same manner as in Example 1 and served as an anode and a stainless steel plate serving as a cathode under the same conditions used in Example 1.

COMPARATIVE EXAMPLE 2

Spark discharge was generated in a 200 g/l aqueous solution of $K_2O.nSiO_2$ using an aluminum plate which had been treated in the same manner as in Example 1 and served as an anode and a stainless steel plate serving as a cathode under the same conditions used in Example 2.

COMPARATIVE EXAMPLE 3

Spark discharge was generated in a 70 g/l aqueous solution of $Na_4P_2O_7.10H_2O$ using an aluminum plate which had been treated in the same manner as in Example 1 and served as an anode and a stainless steel plate serving as a cathode under the same conditions used in

EXAMPLE 3.

Various physical properties of the films obtained in Examples 1 to 8 and Comparative Examples 1 to 3 were measured. The results obtained are summarized in the following Table I.

In Table I, the film thickness, hardness, dielectric breakdown voltage and wear resistance of the films were determined according to the following methods.

FILM THICKNESS

This was determined with an eddy-current type thickness meter, PERMASCOPE E 110B (available from Fischer Company).

HARDNESS

A test specimen was dried at 110° C. for one hour, allowed to cool, the tip thereof was polished flat and smooth, a pencil whose tip had been sharpened was strongly pressed against the coated face at an angle of 45° and was moved on the face at a uniform velocity (3 cm/sec). The hardness of the film was expressed in terms of the hardness of the pencil at which the film was not broken in at least four measurements among five runs in all.

DIELECTRIC BREAKDOWN VOLTAGE

The dielectric breakdown voltage was determined with a dielectric breakdown voltmeter B-5110AF Type (available from Faice Co., Ltd.) according to the varnish coating test method which is one of dielectric strength tests for solid electrical insulation materials (see JIS C2110).

WEAR RESISTANCE

A Suga abrasion tester (available from SUGA TESTER MANUFACTURING CO., LTD.) was used for estimating the wear resistance of each film under the following conditions. In this test, previous abrasion was performed 100 ds (double strokes).

| | |
|---|---|
| Abrasive strip | CC #400 |
| Test cycle | 400 ds |
| Load | 500 gf |
| Speed of friction movement | 40 ds |
| Wheel | rubber |

TABLE I

| | | Composition of Electrolyte | | | | Physical Properties of the Resulting Film | | | | |
|---|---|---|---|---|---|---|---|---|---|---|
| | Substrate | Composition of Soluble Component | Concn. (g/l) | Fine Particle Component | Concn. (g/l) | Film Thickness (μ) | Hardness (H) | Dielectric Breakdown Voltage | Abrasion Resistance (ds/μm) | Color Tone |
| Example | | | | | | | | | | |
| 1 | Al | $Na_2B_4O_7.10H_2O$ | 70 | $SiO_2$ Fine Particles (av. particle size: 2.0 μm) | 15 | 34 | 7 | 320 | 64 | White |
| 2 | Al | $K_2O.nSiO_2$ | 200 | $Al_2O_3$ Fine Particles (av. particle size: 1.1 μm) | 20 | 31 | 4 | 280 | 8 | White |
| 3 | Al | $Na_4P_2O_7.10H_2O$ | 70 | $Al_2O_3$ Fine Particles (av. particle size: 1.1 μm) | 20 | 28 | 7 | 320 | 67 | White |
| 4 | Al | $Na_4P_2O_7.10H_2O$ | 70 | $A(OH)_3$ Fine Particles (av. particle size: 0.6 μm) | 20 | 27 | 7 | 300 | 17 | White |
| 5 | Ti | $Na_4P_2O_7.10H_2O$ | 70 | $Al_2O_3$ | 20 | 36 | 8 | 430 | 38 | White |

TABLE I-continued

| | Sub-strate | Composition of Electrolyte | | | | Physical Properties of the Resulting Film | | | | |
|---|---|---|---|---|---|---|---|---|---|---|
| | | Composition of Soluble Component | Concn. (g/l) | Fine Particle Component | Concn. (g/l) | Film Thickness (μ) | Hard-ness (H) | Dielectric Breakdown Voltage | Abrasion Resistance (ds/μm) | Color Tone |
| | | | | Fine Particles (av. particle size: 1.1 μm) | | | | | | |
| 6 | Al | $Na_4P_2O_7.10H_2O$ | 80 | $Cr_2O_3$ | 50 | 14 | 6 | 310 | 131 | Black |
| | | | | Fine Particles | | | | | | |
| 7 | Al | $Na_4P_2O_7.10H_2O$ | 60 | $Cr_2O_3$ | 70 | 15 | 7 | 280 | 156 | Green |
| | | | | Fine Particles | | | | | | |
| 8 | Al | $Na_2B_4O_7.10H_2O$ | 100 | SiC | 5 | 27 | 7 | 330 | 48 | Pale Brown |
| | | | | Fine Particles | | | | | | |
| Comparative Example | | | | | | | | | | |
| 1 | Al | $Na_2B_4O_7.10H_2O$ | 70 | — | — | 14 | 5 | 240 | 42 | White |
| 2 | Al | $K_2O.nSiO_2$ | 200 | — | — | 25 | 3 | 240 | 5 | White |
| 3 | Al | $Na_4P_2O_7.10H_2O$ | 70 | — | — | 18 | 6 | 270 | 57 | White |

As seen from the results shown in Table I, the films obtained in Examples 1 and 2 show hardness and dielectric breakdown voltage higher than those of the films obtained in Comparative Examples 1 and 2. It is likewise clear that the films obtained in Examples 3 to 8 have excellent properties compared with those of the film obtained in Comparative Example 3.

EXAMPLE 9

An aluminum plate was degreased, etched with an alkali and activated with an acid to clean the plate. Spark discharge was carried out in a dispersion obtained by dispersing 3 g/l of fine particles of fluorinated graphite (available from Central Glass Co., Ltd. under the trade name of SEFBON having an average particle size of 2 μm) in a 70 g/l aqueous solution of $Na_4P_2O_7.10H_2O$ with the aid of 0.3 g/l of a non-ionic surfactant (available from Nikka Chemicals, Ltd., under the trade name of PELTEX 1225), using the aluminum plate as an anode and a stainless steel plate as a cathode. In this stage, the electrolyte was sufficiently stirred so as not to cause sedimentation of the fine particles of the fluorinated graphite to thus ensure a good suspended state thereof. The spark discharge was continued at a current density of 1 A/dm$^2$ and a temperature of 40° C. for 60 minutes to give a film having a thickness of 10 μm. The film was analyzed by an X-ray microanalyzer. As a result, the presence of Al, O, C and F was detected. This indicates that a ceramic film containing fluorinated graphite was certainly formed.

EXAMPLE 10

With the same anode and cathode as those used in Example 9, spark discharge was carried out at a current density of 1 A/dm$^2$ and a temperature of 40° C. for 60 minutes in a solution obtained by suspending 40 g/l of $Al_2O_3$ fine particles (available from SHOWA DENKO KK. under the trade name of REACTIVE ALUMINA AL-160SG having an average particle size of 0.4 μm) and a sol in which 50 g/l of $MoS_2$ fine particles (available from Hitachi Powder Metallurgy Co., Ltd. under the trade name of HITASOL MA-407S) are dispersed in 70 g/l aqueous solution of $Na_4P_2O_7.10H_2O$. As a result, a composite film having an average film thickness of 15 μm was obtained and the presence of Al, O, Mo and S was detected by an X-ray microanalyzer. This indicates that molybdenum disulfide was co-precipitated.

EXAMPLE 11

With the same anode and cathode as those used in Example 9, spark discharge was carried out at a current density of 1 A/dm$^2$ and a temperature of 30° C. for 40 minutes in a solution obtained by suspending 40 g/l of $Al_2O_3$ fine particles (available from SHOWA DENKO KK. under the trade name of REACTIVE ALUMINA AL-160SG) and a sol in which 50 g/l of graphite fine particles (available from Hitachi Powder Metallurgy Co., Ltd. under the trade name of AB-1D having an average particle size of 1 μm) are dispersed in 70 g/l aqueous solution of $Na_4P_2O_7.10H_2O$.

As a result, a composite film having an average film thickness of 13 μm was obtained and the presence of Al, O and C was detected by an X-ray microanalyzer. This indicates that graphite fine particles were surely co-deposited.

EXAMPLE 12

With the same anode and cathode as those used in Example 9, spark discharge was carried out at a current density of 1 A/dm$^2$ and a temperature of 30° C. for 40 minutes in a solution obtained by suspending 40 g/l of $Al_2O_3$ fine particles (available from SHOWA DENKO KK. under the trade name of REACTIVE ALUMINA AL-160SG) in 70 g/l aqueous solution of $Na_4P_2O_7.10H_2O$ in which a sol containing 2 g/l of tetrafluoroethylene resin fine particles (available from Central Glass Co., Ltd. under the trade name of CEFURAL LOOVE-I having an average particle size of 3 μm) were further dispersed with the aid of a fluorine atom-containing non-ionic surfactant (available from DAI-NIPPON INK AND CHEMICALS, INC. under the trade name of Megafack F-142D) as a dispersant.

As a result, a composite film having an average film thickness of 14 μm was obtained and the presence of Al, O, F and C was detected by an X-ray microanalyzer. This indicates that the tetrafluoroethylene resin fine particles were certaily co-deposited. Comparative Example 4

With an aluminum plate which had been cleaned in the same manner used in Example 9 and served as an anode and a stainless steel plate serving as a cathode, spark discharge was performed in a 70 g/l aqueous solution of $Na_4P_2O_7.10H_2O$ under the same conditions used in Example 9.

The results obtained are listed in the following Table II.

TABLE II

| | | Composition of Electrolyte | | | | | |
|---|---|---|---|---|---|---|---|
| | Substrate | Composition of Soluble Component | Concn. (g/l) | Ceramics Fine Particle Component | Concn. (g/l) | Self-Lubricating Fine Particle | Concn. (g/l) |
| Example | | | | | | | |
| 9 | Al | $Na_2P_2O_7.10H_2O$ | 70 | | | Fluorinated Graphite Fine Particles | 3 |
| 10 | Al | $Na_2P_2O_7.10H_2O$ | 70 | $Al_2O_3$ Fine Particles | 40 | $MoS_2$ Fine Particles | 50 |
| 11 | Al | $Na_2P_2O_7.10H_2O$ | 70 | $Al_2O_3$ Fine Particles | 40 | Sol of Graphite Fine Particles | 10 |
| 12 | Al | $Na_2P_2O_7.10H_2O$ | 70 | $Al_2O_3$ Fine Particles | 40 | Tetrafluoroethylene Resin Fine Particles | 2 |
| Comparative Example | | | | | | | |
| 4 | Al | $Na_2P_2O_7.10H_2O$ | 70 | $Al_2O_3$ Fine Particles | | | |

| | Physical Properties of the Resulting Film | | | | |
|---|---|---|---|---|---|
| | Film Thickness (μ) | Hardness (H) | Dielectric Breakdown Voltage | Abrasion Resistance (ds/μm) | Color Tone |
| Example | | | | | |
| 9 | 11 | 6 | 200 | 95 | Pale Brown |
| 10 | 15 | 7 | 280 | 192 | Pale Brown |
| 11 | 13 | 7 | 230 | 154 | Pale Brown |
| 12 | 14 | 7 | 220 | 148 | White |
| Comparative Example | | | | | |
| 4 | 10 | 6 | 260 | 39 | White |

What is claimed is:

1. A method for forming a ceramic film on the surface of a substrate by spark discharge performed in an electrolytic bath, said electrolytic bath consisting essentially of an aqueous solution of an oxyacid salt selected from the group consisting of tungstates, stannates, molybdates, borates, aluminates and phosphates in which fine ceramic particles having particle sizes ranging from 0.03 to 100 μm and selected from the group consisting of $Al_2O_3$, $Al(OH)_3$, $SiO_2$, $3Al_2O_3.2SiO_2$, $TiO_2$, $ZrO_2$, $Cr_2O_3$, SiC, TiC, TiN, TiB, ZrB, BN, WC, $WSi_2$, and $MoSi_2$ are dispersed and the spark discharge being conducted in the electrolytic bath at a bath temperature ranging from 5° of 90° C. and a current density ranging from 0.2 to 20 A/dm$^2$ for not less than 5 minutes while ensuring the suspended state of the ceramic particles in the electrolytic bath.

2. The method of claim 1, wherein the concentration of the oxyacid salt in the aqueous solution used as the electrolytic bath ranges from 25 to 200 g/l.

3. The method of claim 1, wherein the particle size of the ceramic particles ranges from 0.03 to 20 μm.

4. The method of claim 1, wherein the amount of fine ceramic particles added to the electrolytic bath ranges from 5 to 100 g/l.

5. The method of claim 1, wherein the spark discharge is conducted at a bath temperature ranging from 15° to 60° C. and a current density ranging from 1 to 5 A/dm$^2$ for 10 to 60 minutes.

6. The method of claim 1, wherein the substrate is a metal substrate and the metal of the substrate on which the ceramic film is formed is a member selected from the group consisting of aluminum and alloys thereof, zirconium, titanium, niobium, magnesium and alloys thereof.

7. A method for forming a ceramic film on the surface of a substrate by spark discharge performed in an electrolytic bath, said electrolytic bath consisting essentially of an oxyacid salt selected from the group consisting of tungstates, stannates, molybdates, borates, aluminates and phosphates in which fine particles having particle sizes ranging from 0.01 to 100 μm and selected from the group consisting of molybdenum disulfide, carbon, fluorinated graphite and tetrafluoroethylene resin are dispersed and the spark discharge being conducted in the electrolytic bath at a bath temperature ranging from 5° to 90° C. and a current density ranging from 0.2 to 20 A/dm$^2$ for not less than 5 minutes while ensuring the suspended state of the fine particles in the bath.

8. The method of claim 7, wherein the particle size of the fine particles ranges from 0.03 to 20 μm.

9. The method of claim 7, wherein the spark discharge is conducted at a bath temperature ranging from 15° to 60° C. and a current density ranging from 1 to 5 A/dm$^2$ for 10 to 60 minutes.

10. The method of claim 7, wherein the amount of the fine particles added to the electrolytic bath ranges from 5 to 100 g/l.

11. The method of claim 7, wherein the substrate is a metal substrate and the metal of the substrate on which the ceramic film is formed is a member selected from the group consisting of aluminum and alloys thereof, zirconium, titanium, niobium, magnesium and alloys thereof.

12. A method for forming a ceramic film on the surface of a substrate by spark discharge performed in an electrolytic bath, said electrolytic bath consisting essentially of an oxyacid salt selected from the group consisting of tungstates, stannates, molybdates, borates, aluminates and phosphates in which fine ceramic particles having particle sizes ranging from 0.03 to 100 μm and selected from the group consisting of $Al_2O_3$, $Al(OH)_3$, $SiO_2$, $3Al_2O_3.2SiO_2$, $TiO_2$, $ZrO_2$, $Cr_2O_3$, SiC, TiC, TiN, TiB, ZrB, BN, WC, $WSi_2$ and $MoSi_2$ are dispersed and in which fine particles having particle sizes ranging from 0.01 to 100 μm and selected from the group consisting of molybdenum disulfide, carbon, fluorinated graphite and tetrafluoroethylene resin are dispersed and the spark discharge being conducted in the electrolytic bath at a bath temperature ranging from 5° to 90° C. and a current density ranging from 0.2 to 20 $A/dm^2$ for not less than 5 minutes while ensuring the suspended state of the fine particles in the bath.

13. The method of claim 7, wherein the fine particles are selected from the group consisting of molybdenum disulfide and tetrafluoroethylene resin.

* * * * *